US009335018B2

(12) United States Patent
Han

(10) Patent No.: US 9,335,018 B2
(45) Date of Patent: May 10, 2016

(54) LED LAMP INCLUDING REFLECTORS FOR VEHICLE AND VEHICLE HAVING THE SAME

(71) Applicant: HYUNDAI MOBIS CO., LTD., Seoul (KR)

(72) Inventor: Seong Yeon Han, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 139 days.

(21) Appl. No.: 14/177,276

(22) Filed: Feb. 11, 2014

(65) Prior Publication Data

US 2015/0009698 A1 Jan. 8, 2015

(30) Foreign Application Priority Data

Jul. 3, 2013 (KR) ..... 10-2013-0077954

(51) Int. Cl.

| | |
|---|---|
| ***F21S 8/10*** | (2006.01) |
| ***F21V 7/00*** | (2006.01) |
| *F21Y 105/00* | (2016.01) |
| *F21Y 101/02* | (2006.01) |

(52) U.S. Cl.

CPC ..... *F21S 48/1258* (2013.01); *F21S 48/1154* (2013.01); *F21S 48/1305* (2013.01); *F21S 48/1323* (2013.01); *F21S 48/1388* (2013.01); *F21V 7/0083* (2013.01); *F21Y 2101/02* (2013.01); *F21Y 2105/005* (2013.01)

(58) Field of Classification Search

CPC ..... F21S 48/1323; F21S 48/1305; F21S 48/1154; F21S 48/1388; F21S 48/1159; F21S 48/1258; F21V 7/0083; F21V 7/00; F21V 7/07; F21Y 2105/005

USPC ..... 362/545, 241, 245, 247

See application file for complete search history.

(56) References Cited

U.S. PATENT DOCUMENTS

| | | | | |
|---|---|---|---|---|
| 3,290,539 | A * | 12/1966 | Lamorte | H01L 27/1446 250/504 R |
| 6,443,594 | B1 * | 9/2002 | Marshall | F21V 5/007 362/236 |
| 8,931,939 | B2 * | 1/2015 | Melzner | F21V 5/002 362/244 |
| 2014/0133168 | A1 * | 5/2014 | Fiederling | F21S 48/1241 362/511 |

FOREIGN PATENT DOCUMENTS

| | | | | |
|---|---|---|---|---|
| JP | WO 2013183240 | A1 * | 12/2013 | F21S 48/1159 |

* cited by examiner

*Primary Examiner* — Robert May
(74) *Attorney, Agent, or Firm* — NSIP Law

(57) ABSTRACT

A lamp for a vehicle is provided. The lamp includes an LED array in which a plurality of LEDs is aligned at the same position based on an illumination direction, an aspherical lens which is disposed in front of the LED array, and a plurality of reflectors on the plurality of LEDs so as to reflect light emitted from the LEDs to the aspherical lens, in which a distance from a rear end to a front end of the reflector based on the illumination direction becomes greater as the reflector is disposed farther away from an optical axis that passes through a focal point of the aspherical lens, and the lamp reduces an aberration so as to prevent a light blurring phenomenon.

5 Claims, 3 Drawing Sheets

[RELATED ART]

FIG. 3 [RELATED ART]
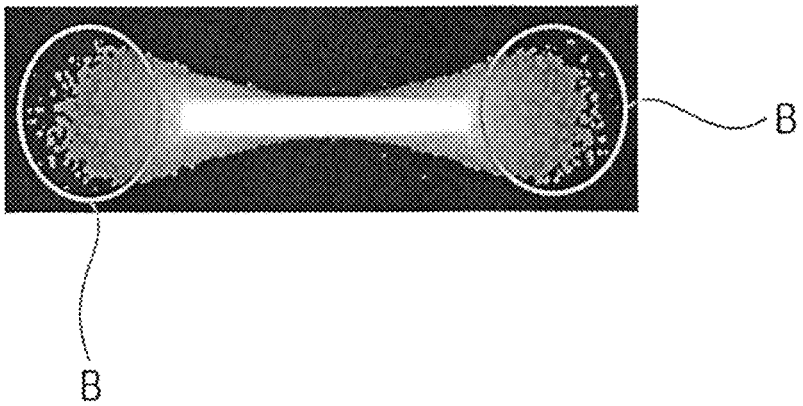
FIG. 4
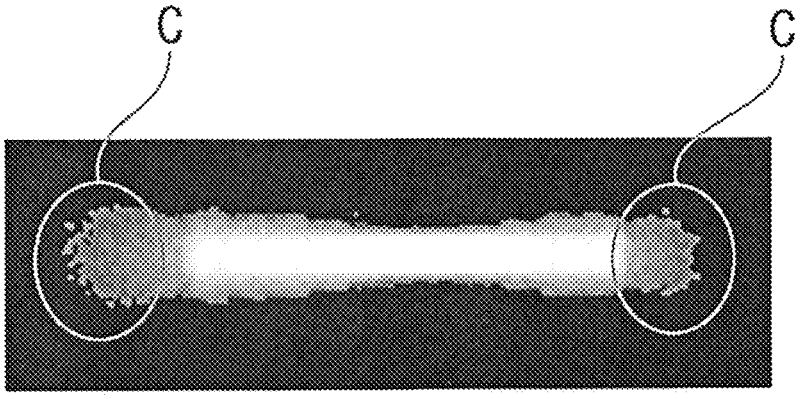

LED LAMP INCLUDING REFLECTORS FOR VEHICLE AND VEHICLE HAVING THE SAME

CROSS-REFERENCE TO RELATED APPLICATIONS

This application claims priority to and the benefit of Korean Patent Application No. 10-2013-0077954 filed in the Korean Intellectual Property Office on Jul. 3, 2013, the entire contents of which are incorporated herein by reference.

1. Technical Field

The disclosed technology relates to a lamp for a vehicle and a vehicle having the same, and more particularly, to a lamp for a vehicle, which uses a multi-array type LED array as a light source, and a vehicle having the same.

2. Background Art

Various types of bulbs have been used initially as a light source of a lamp for a vehicle, but recently, a light emitting diode (LED), which has excellent efficiency of converting electricity into light and a low amount of heat radiation, may be reduced in size and weight, and has a long lifespan, has been widely used as a light source.

In general, the LED has an advantage in that a color temperature of the LED is about 5,500 K, which is close to a color temperature of sun light, so as to reduce eye strain that causes fatigue, and the LED has an advantage in that a size of the LED is small so as to increase a degree of design freedom when a lamp for a vehicle is designed.

An LED array is a type of a light source formed by mounting a plurality of LEDs, and may directly implement various beam patterns by selectively turning on the plurality of LEDs. Therefore, the LED array may be applied to a head lamp and a rear lamp of a vehicle so as to be effectively used to implement various beam patterns.

FIG. 1 is a view illustrating a lamp for a vehicle which uses an LED array as a light source and uses an aspherical lens.

Referring to FIG. 1, a lamp for a vehicle may be configured by installing an aspherical lens 20 in front of an LED array 10. Light passing through a focal point F of the aspherical lens 20 goes straight after passing through the aspherical lens 20. In a case in which the focal point F is positioned on an optical axis, the light passing through the aspherical lens 20 goes parallel to the optical axis.

Here, the LED array 10 typically has a plurality of LEDs that is disposed to be aligned in a predetermined direction. Therefore, because the light, which is emitted in the vicinity of an upper end and a lower end (A of FIG. 1) of the LED array 10 which are positioned relatively far away from the focal point F of the aspherical lens 20, deviates from the focal point F of the aspherical lens 20, there is a problem in that an aberration is generated after the light penetrates the aspherical lens 20, and thereby, a light blurring phenomenon occurs.

SUMMARY

An embodiment of the present invention provides a lamp for a vehicle and a vehicle having the same, which may reduce an aberration so as to prevent light blurring when using an LED array and an aspherical lens.

An embodiment of the present invention provides a lamp for a vehicle, which includes an LED array in which a plurality of LEDs is aligned at the same position based on an illumination direction, and an aspherical lens disposed in front of the LED array, the lamp including: reflectors disposed on the plurality of LEDs so as to reflect light emitted from the LEDs to the aspherical lens, in which a distance from a rear end to a front end of the reflector based on the illumination direction becomes greater as the reflector is disposed farther away from an optical axis that passes through a focal point of the aspherical lens.

Widths of the plurality of reflectors may be different from each other based on an alignment direction of the LEDs.

A width of the reflector may become greater as the reflector is disposed farther away from the optical axis based on an alignment direction of the LEDs.

The reflector may include any one reflective surface of a reflective surface having a parabola shape, and a reflective surface having a hyperbola shape.

Another embodiment of the present invention provides a vehicle including the aforementioned lamp for a vehicle.

According to the lamp for a vehicle according to the present invention and the vehicle having the same, the reflectors are installed to the LEDs of the LED array, respectively, the distance from the rear end to the front end of the reflector is formed to be greater as the reflector is positioned farther away from the optical axis that passes through the focal point of the aspherical lens, such that the distance between the illumination position and the center of the aspherical lens becomes short, thereby reducing an aberration and providing an advantageous effect that prevents a light blurring phenomenon.

The foregoing summary is illustrative only and is not intended to be in any way limiting. In addition to the illustrative aspects, embodiments, and features described above, further aspects, embodiments, and features will become apparent by reference to the drawings and the following detaiLED description.

BRIEF DESCRIPTION OF THE DRAWINGS

FIG. 3 is a picture of an image when a lamp for a vehicle in the related art in which light blurring is generated due to an aberration is turned on.

FIG. 4 is a picture of an image when the lamp for a vehicle according to an embodiment of the present invention in which an aberration is improved so that light blurring is reduced is turned on.

Figure 1:
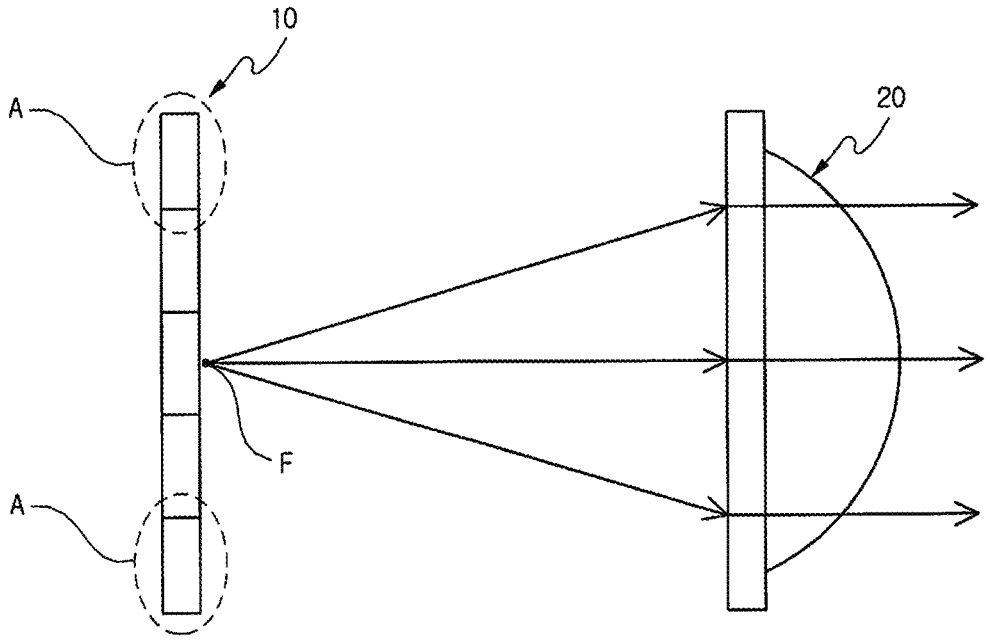
FIG. 1 is a view illustrating a lamp for a vehicle which uses an LED array as a light source and uses an aspherical lens.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, an embodiment of the present invention will be described in detail with reference to the accompanying drawings. First, in denoting reference numerals to constituent elements of respective drawings, it should be noted that the same elements will be designated by the same reference numerals although they are shown in different drawings. Hereinafter, a preferred embodiment of the present invention will be described, but, of course, the technical spirit of the present invention is not restricted or limited thereto, but the preferred embodiment of the present invention may be modified by a person with ordinary skill in the art to be variously performed.

The embodiment of the present invention has a technical feature in that an aberration is reduced by forming a distance between an illumination position and a center of an aspherical lens to be short as a reflector is positioned farther away from a focal point of the aspherical lens.

Figure 2:
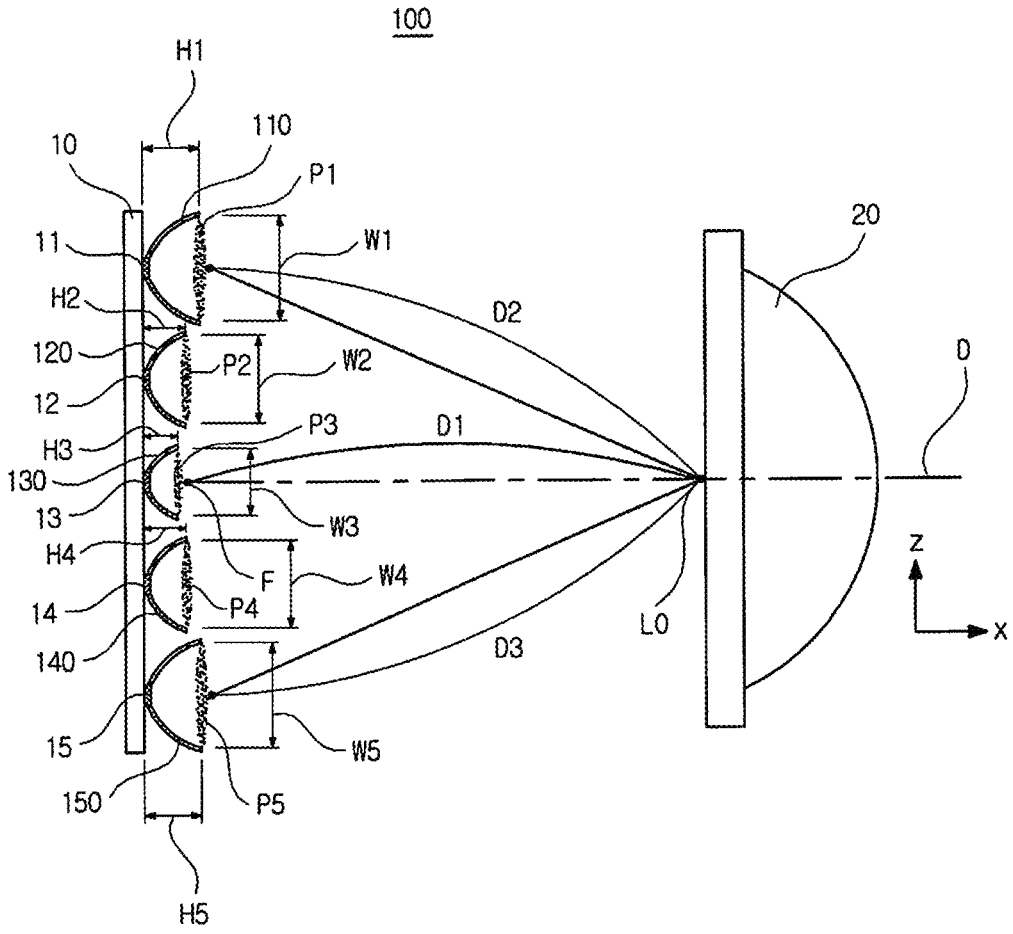
FIG. 2 is a view illustrating a lamp for a vehicle according to an embodiment of the present invention.

FIG. 2 is a view illustrating a lamp for a vehicle according to an embodiment of the present invention. FIG. 2 clearly illustrates only a main characteristic part for conceptual and clear understanding of the present invention. As a result, various modifications to the illustrations are expected, and the scope of the present invention is not limited to specific shapes illustrated in the drawings.

Referring to FIG. 2, in a lamp 100 for a vehicle, according to an embodiment of the present invention, reflectors 110, 120, 130, 140, and 150 may be installed to LEDs 11, 12, 13, 14, and 15 of an LED array 10, respectively. The reflectors 110, 120, 130, 140, and 150 serve to reflect light, which is emitted from the LEDs 11, 12, 13, 14, and 15, in a direction of an aspherical lens 20.

The heights of the reflectors 110, 120, 130, 140, and 150 may increase as the reflectors 110, 120, 130, 140, and 150 become farther away from an optical axis D that passes through a focal point F of the aspherical lens 20. The aforementioned configuration helps to reduce an aberration by getting a distance between an illumination position and a center LO of the aspherical lens 20 to be shorter as the reflector becomes farther away from the focal point F of the aspherical lens 20.

Here, the heights of the reflectors 110, 120, 130, 140, and 150 mean distances H1, H2, H3, H4, and H5 from rear ends to front ends of the corresponding reflectors 110, 120, 130, 140, and 150 based on an illumination direction (an x-axis direction of FIG. 2). As the heights of the reflectors 110, 120, 130, 140, and 150 increase, the illumination positions of the LEDs 11, 12, 13, 14, and 15 are positioned further forward based on the illumination direction.

That is, mixing regions P1, P2, P3, P4, and P5 of the light emitted from the LEDs 11, 12, 13, 14, and 15 are formed in the vicinity of the front ends of the respective reflectors 110, 120, 130, 140, and 150, and as the heights of the reflectors 110, 120, 130, 140, and 150 increase, distances between the mixing regions P1, P2, P3, P4, and P5 of the light and the center LO of the aspherical lens 20 become shorter.

For example, when a distance between the mixing region P3 of the light of the reflector 130, which is installed on the LED 13 positioned on the optical axis D, and the center LO of the aspherical lens 20 is referred to as D1, a distance between the mixing region P1 of the light of the reflector 110, which is installed on the LED 11 positioned at the uppermost end of the LED array 10, and the center LO of the aspherical lens 20 is referred to as D2, and a distance between the mixing region P5 of the light of the reflector 150, which is installed on the LED 15 positioned at the lowermost end of the LED array 10, and the center LO of the aspherical lens 20 is referred to as D3, a value of D1 is the smallest among values of D1, D2 and D3, and as D2 and D3 becomes similar to D1, an aberration may be reduced because light routes become similar to each other.

Accordingly, in the embodiment of the present invention, the heights of the reflectors, which are disposed far away from the optical axis D, for example, the reflectors 110 and 150 of FIG. 2, are formed to be greater, such that the light routes from the illumination positions of the respective reflectors 110, 120, 130, 140, and 150 to the center LO of the aspherical lens 20 are configured to be similar to each other.

Meanwhile, widths W1, W2, W3, W4, and W5 of the plurality of reflectors 110, 120, 130, 140, and 150 based on an alignment direction (a z-axis direction of FIG. 2) of the LEDs 11, 12, 13, 14, and 15 may be formed to be different from or identical with each other in consideration of usage of reflective surfaces of the respective reflectors 110, 120, 130, 140, and 150 and the lamp 100 for a vehicle.

The reflective surfaces of the reflectors 110, 120, 130, 140, and 150 may have a parabola shape, or a hyperbola shape depending on usage of the lamp 100 for a vehicle.

FIG. 3 is a picture of an image when a lamp for a vehicle in the related art in which light blurring is generated due to an aberration is turned on, and FIG. 4 is a picture of an image when the lamp for a vehicle according to an embodiment of the present invention in which an aberration is corrected so that light blurring is reduced is turned on.

As illustrated by B of FIG. 3 that illustrates an image when a lamp for a vehicle in the related art is turned on, a light blurring phenomenon due to an aberration may occur in a region that is spaced apart from a focal point of an aspherical lens. However, it can be seen that in an image implemented when the lamp for a vehicle according to the embodiment of the present invention is turned on, a light blurring phenomenon is greatly reduced due to a corrected aberration, as illustrated by C of FIG. 4.

As described above, the embodiments have been described and illustrated in the drawings and the specification. The embodiments were chosen and described in order to explain certain principles of the invention and their practical application, to thereby enable others skilled in the art to make and utilize various embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A lamp for a vehicle, the lamp comprising:

an LED array having a plurality of LEDs aligned at the same position based on an illumination direction, an aspherical lens disposed in front of the LED array, and a plurality of reflectors disposed on the plurality of LEDs, the plurality of the reflectors reflecting light emitted from the LEDs to the aspherical lens, wherein a distance from a rear end to a front end of the reflector based on the illumination direction becomes greater as the reflector is disposed farther away from an optical axis that passes through a focal point of the aspherical lens, and wherein the distance from the rear end to the front end for each of the reflectors is consistent within a same reflector.

2. The lamp of claim 1, wherein widths of the plurality of reflectors are different from each other based on an alignment direction of the LEDs.

3. The lamp of claim 1, wherein a width of the reflector becomes greater as the reflector is disposed farther away from the optical axis based on an alignment direction of the LEDs.

4. The lamp of claim 1, wherein the reflector comprises a reflective surface having a parabola shape or a reflective surface having a hyperbola shape.

5. A vehicle comprising the lamp according to claim 1.

* * * * *